US009384953B2

(12) United States Patent
Fujita

(10) Patent No.: US 9,384,953 B2
(45) Date of Patent: Jul. 5, 2016

(54) TANDEM QUADRUPOLE MASS SPECTROMETER

(71) Applicant: SHIMADZU CORPORATION, Kyoto-shi, Kyoto (JP)

(72) Inventor: Shinjiro Fujita, Kameoka (JP)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 14/439,731

(22) PCT Filed: Nov. 13, 2012

(86) PCT No.: PCT/JP2012/079399
§ 371 (c)(1),
(2) Date: Apr. 30, 2015

(87) PCT Pub. No.: WO2014/076766
PCT Pub. Date: May 22, 2014

(65) Prior Publication Data

US 2015/0262799 A1 Sep. 17, 2015

(51) Int. Cl.
*H01J 49/26* (2006.01)
*H01J 49/00* (2006.01)
*H01J 49/42* (2006.01)

(52) U.S. Cl.
CPC ..... *H01J 49/005* (2013.01); *H01J 49/4215* (2013.01)

(58) Field of Classification Search
USPC ..... 250/281, 282, 283, 287, 288
See application file for complete search history.

(56) References Cited

U.S. PATENT DOCUMENTS

2006/0284080 A1* 12/2006 Makarov et al. ..... 250/290
2013/0214146 A1* 8/2013 Okumura ..... 250/281
2014/0034827 A1* 2/2014 Mordehai et al. ..... 250/283

FOREIGN PATENT DOCUMENTS

JP 2011-249109 12/2011
WO 2009/095958 A1 8/2009

OTHER PUBLICATIONS

European Search Report issued Oct. 9, 2015 in European Patent Application No. 12888305.5.

* cited by examiner

*Primary Examiner* — Nicole Ippolito
(74) *Attorney, Agent, or Firm* — Sughrue Mion, PLLC

(57) ABSTRACT

A measurement condition memory stores a CID gas condition table indicating a relation between the scan speed of a mass scan by a front-stage quadrupole mass filter and a CID gas supply pressure. If the scan speed is high, an influence of a decrease in speed of ions due to collisions with a CID gas inside a collision cell is relatively large. An appropriate CID gas supply pressure that reduces the decay of a peak waveform on a mass spectrum and makes the ion intensity as high as possible is examined in advance for each scan speed, and is stored in advance. During measurement of a target sample, if a precursor ion scan measurement mode or the like is designated, a CID gas supply pressure corresponding to the currently set scan speed is obtained based on the CID gas condition table, and the CID gas supplier is controlled.

8 Claims, 4 Drawing Sheets

TANDEM QUADRUPOLE MASS SPECTROMETER

CROSS REFERENCE TO RELATED APPLICATIONS

This is a National Stage of International Application No. PCT/JP2012/079399 filed Nov. 13, 2012, the contents of which are incorporated herein by reference in its entirety.

TECHNICAL FIELD

The present invention relates to a tandem quadrupole mass spectrometer which dissociates ions having a specific mass-to-charge ratio m/z through collision-induced dissociation (CID) or the like, and performs a mass spectrometric analysis on product ions (fragment ions) produced through the dissociation.

BACKGROUND ART

A method called an MS/MS analysis (also called a tandem analysis) is known as one of the mass spectrometric techniques for identification and structural analyses of compounds having large molecular weights. A tandem quadrupole mass spectrometer (also called a triple quadrupole mass spectrometer) having a relatively simple and inexpensive structure is one of the widely used mass spectrometers capable of the MS/MS analysis.

As disclosed in Patent Literature 1, generally in the tandem quadrupole mass spectrometer, quadrupole mass filters are respectively provided at the front and rear stages of a collision cell for dissociating ions so as to sandwich the collision cell. Precursor ions are selected by the front-stage quadrupole mass filter from among a variety of ions originating from a target compound, and product ions are separated by the rear-stage quadrupole mass filter in accordance with the mass-to-charge-ratio. The collision cell has a box-like, relatively tight-sealed structure, and a CID gas such as argon and nitrogen is introduced into the collision cell. The precursor ions selected by the front-stage quadrupole mass filter are introduced into the collision cell endowed with appropriate collision energy, and collide with the CID gas inside the collision cell. As a result, collision-induced dissociation occurs, and the product ions are produced.

The dissociation efficiency of ions inside the collision cell depends on the amount of collision energy of the ions, the CID gas pressure inside the collision cell, and the like. Hence, the detection sensitivity of the product ions that have passed through the rear-stage quadrupole mass filter also depends on the amount of collision energy and the CID gas pressure.

In the tandem quadrupole mass spectrometer, a measurement in a multiple reaction monitoring (MRM) mode is performed in many cases, in order to perform quantitative determination on a known compound with high accuracy. In the MRM measurement mode, for both the front-stage and rear-stage quadrupole mass filters, the mass-to-charge-ratios of the ions that pass through the filters are fixed. Hence, in conventional tandem quadrupole mass spectrometers, the CID gas pressure inside the collision cell is set to a value (normally, at several mTorr) in advance by a manufacturer such that the detection sensitivity is as high as possible in the MRM measurement mode.

In general, as the CID gas pressure inside the collision cell becomes higher, ions become more likely to contact the CID gas, and hence the dissociation efficiency of the ions becomes higher. However, the kinetic energy of the ions (both the precursor ions and the product ions) is attenuated by the collision with the gas, the flight speed of the ions decreases as a whole, and the variation range of the speed increases. In the case of the MRM measurement mode, dissociation of ions having the same mass-to-charge-ratio and selection and detection of product ions having the same mass-to-charge-ratio are performed for a certain amount of period, and hence the decrease in ion flight speed and the increase in speed variation range in the collision cell as described above have relatively small influences.

However, in the case of a precursor ion scan measurement mode, a neutral loss scan measurement mode, and the like in which the front-stage quadrupole mass filter performs a scan over a predetermined mass-to-charge-ratio range, the decrease in ion flight speed and the increase in speed variation range inside the collision cell may cause problems. That is, if the front-stage quadrupole mass filter performs a mass scan at a high speed, the following phenomenon is more likely to occur: before a product ion produced from a precursor ion having a given mass-to-charge-ratio M reaches a detector, a product ion produced from a precursor ion having a mass-to-charge-ratio M+ΔM catches up with the product ion. This means that separation between a given ion peak and another ion peak adjacent to the given ion peak on a mass spectrum (MS/MS spectrum) deteriorates. Moreover, if the range of the flight speed of the product ions increases, a decrease in peak top intensity becomes remarkable.

CITATION LIST

Patent Literature

[Patent Literature 1] WO 2009/095958 A

SUMMARY OF INVENTION

Technical Problem

The present invention, which has been made in order to solve the above-mentioned problems, has an object to provide a tandem quadrupole mass spectrometer capable of preventing the decay of the shape of a target ion peak on an observed mass spectrum and performing a measurement with high separability and high sensitivity, even in the case where a front-stage quadrupole mass filter performs a high-speed mass scan.

Solution to Problem

The present invention, which has been made in order to solve the above-mentioned problems, provides a tandem quadrupole mass spectrometer including: a front-stage quadrupole mass filter for selecting, as precursor ions, ions having a specific mass-to-charge-ratio from among a variety of ions; a collision cell for causing the precursor ions to collide with a predetermined gas to dissociate the ions; a rear-stage quadrupole mass filter for selecting ions having a specific mass-to-charge-ratio from among a variety of product ions produced through the dissociation; and a detector for detecting the selected product ions, the tandem quadrupole mass spectrometer further including:

a) a gas supplier for supplying the predetermined gas to an inside of the collision cell;

b) a setting information memory for storing information on a gas pressure of the predetermined gas inside the collision cell or control information for supplying the predetermined gas, in association with a scan speed of a mass scan in a measurement mode in which the front-stage quadrupole mass filter performs the mass scan; and c) an analysis controller for controlling the gas supplier such that the gas pressure of the predetermined gas inside the collision cell accords with a scan speed of a mass scan to be performed, based on the information stored in the setting information memory, during execution of a measurement mode in which at least the front-stage quadrupole mass filter performs the mass scan.

Here, the measurement mode in which the front-stage quadrupole mass filter performs the mass scan includes: a precursor ion scan measurement mode; a neutral loss scan measurement mode; and a measurement mode equivalent to a normal scan measurement mode in which only the front-stage quadrupole mass filter performs the mass scan while the rear-stage quadrupole mass filter does not perform ion selection according to a mass-to-charge-ratio.

In the tandem quadrupole mass spectrometer according to the present invention, for example, a mass spectrometer manufacturer empirically examines such a gas pressure that makes a peak on a mass spectrum sufficiently separable and makes the detection sensitivity highest, for each of scan speeds in a plurality of stages (at least two stages) of the mass scan by the front-stage quadrupole mass filter. Based on the examination results, the mass spectrometer manufacturer creates information corresponding to each scan speed, and stores the information into the setting information memory. If a user who has bought the mass spectrometer gives an instruction to execute the measurement mode in which the front-stage quadrupole mass filter performs the mass scan, the analysis controller reads out information associated with the scan speed that is one of the current analysis conditions, from the setting information memory, and controls the supply flow rate and the supply pressure of the predetermined gas from the gas supplier, based on the read-out information. Consequently, the gas pressure of the predetermined gas inside the collision cell is set so as to achieve sufficiently high peak separability and detection sensitivity correspondingly to the scan speed of the mass scan to be performed.

In measurement modes different from "the measurement mode in which the front-stage quadrupole mass filter performs the mass scan" (namely, a product ion scan measurement mode, a MRM measurement mode, and a measurement mode equivalent to a normal scan measurement mode in which only the rear-stage quadrupole mass filter performs a mass scan while the front-stage quadrupole mass filter does not perform ion selection according to a mass-to-charge-ratio), the scan speed of the mass scan by the front-stage quadrupole mass filter can be regarded as lowest, and hence control may be performed using information corresponding to the lowest scan speed among the pieces of information stored in the setting information memory.

Although the information stored in the setting information memory can be determined in advance by the mass spectrometer manufacturer as described above, preferably, an optimum value may be set on the user side for each scan speed based on actual measurement results obtained from a standard sample, for example, as part of automatic mass spectrometer adjustment.

To achieve this, the tandem quadrupole mass spectrometer according to the present invention may further include an automatic setting information creator for: performing repetitive measurements on a predetermined sample while controlling the gas supplier such that the gas pressure of the predetermined gas inside the collision cell is changed in a plurality of stages in each of stages in which the scan speed of the mass scan is changed in a plurality of stages; obtaining an appropriate gas pressure for each scan speed of the mass scan, based on a shape of a target peak and an intensity of the peak on a mass spectrum obtained through each of the measurements; and storing information on the appropriate gas pressure or the control information for supplying the predetermined gas into the setting information memory, in the measurement mode in which the front-stage quadrupole mass filter performs the mass scan.

In this configuration, the automatic setting information creator may determine an optimum gas pressure by determining, on a mass spectrum, the shape of a peak originating from a known compound contained in the predetermined sample and the peak intensity. In this case, the peak shape may be such a peak shape that makes the target peak sufficiently separable from a peak adjacent to the target peak.

In a specific embodiment of the tandem quadrupole mass spectrometer according to the present invention, the automatic setting information creator may determine such a gas pressure that makes a half-value width of the target peak equal to or less than 0.7 u and makes the peak intensity highest, as the appropriate gas pressure.

Moreover, in the case where known compounds contained in the predetermined sample include a compound made of only stable isotope elements and a compound containing isotope elements other than stable isotopes, a peak originating from the compound containing the isotope elements other than the stable isotopes appears on a mass spectrum at a position away by, for example, substantially 1 u, adjacently to a peak originating from the compound made of only the stable isotope elements. In view of this, in another embodiment of the tandem quadrupole mass spectrometer according to the present invention, the automatic setting information creator may determine such a gas pressure that makes a compound peak made of only stable isotope elements separable from a compound peak containing elements other than stable isotopes, among peaks originating from a target compound and makes the peak intensity highest, as the appropriate gas pressure.

Advantageous Effects of Invention

With a tandem quadrupole mass spectrometer according to the present invention, even in the case where a front-stage quadrupole mass filter performs a high-speed mass scan, the decay of a peak waveform on a mass spectrum can be reduced, separability between peaks adjacent to each other can be secured, and high mass resolution can be achieved. In addition, a decrease in intensity of an ion peak to be observed can be reduced, and a target ion can be detected with high sensitivity.

DESCRIPTION OF EMBODIMENTS

Hereinafter, an embodiment of a tandem quadrupole mass spectrometer according to the present invention is described with reference to the attached drawings.

Figure 1:
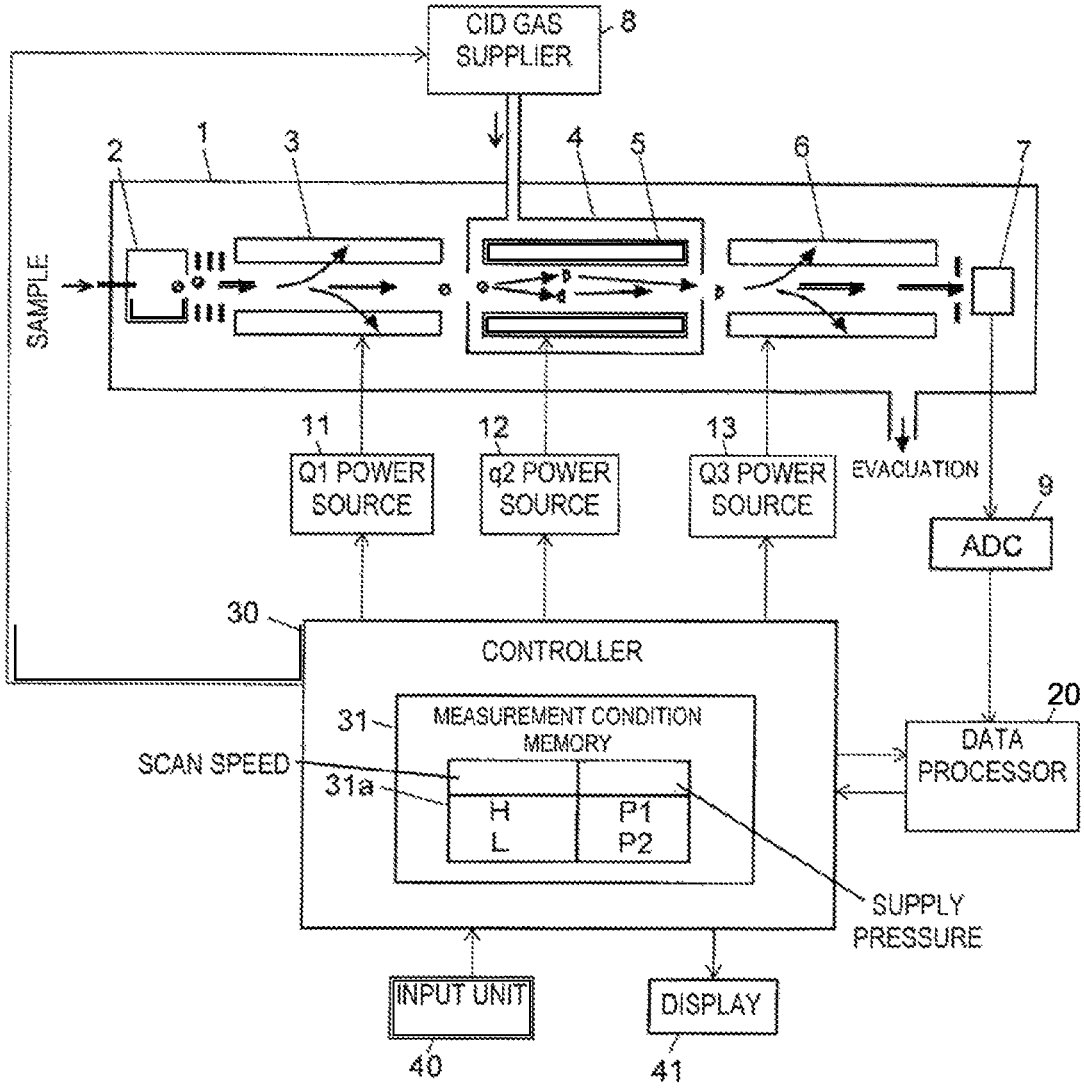
FIG. 1 is a schematic configuration diagram of a main part of a tandem quadrupole mass spectrometer according to a first embodiment of the present invention.

FIG. 1 is a schematic configuration diagram of a main part of a tandem quadrupole mass spectrometer according to a first embodiment.

The tandem quadrupole mass spectrometer of the present embodiment includes an ion source 2, a front-stage quadrupole mass filter (commonly represented as "Q1") 3, a collision cell 4, a rear-stage quadrupole mass filter (commonly represented as "Q3") 6, and a detector 7, inside a chamber 1 evacuated by a vacuum pump (not shown). The ion source 2 ionizes compounds in a sample. The front-stage quadrupole mass filter 3 selectively allows ions having a specific mass-to-charge-ratio to pass through the mass filter 3 as precursor ions. The collision cell 4 dissociates the precursor ions inside the collision cell 4, and produces a variety of product ions. The rear-stage quadrupole mass filter 6 selectively allows ions having a specific mass-to-charge-ratio among the product ions to pass through the mass filter 6. The detector 7 detects the ions that have passed through the rear-stage quadrupole mass filter 6. An ion guide (commonly represented as "q2") 5 for transporting ions while converging the same is arranged inside the collision cell 4. Moreover, a CID gas such as argon is continuously or intermittently supplied to the inside of the collision cell 4 by a CID gas supplier 8 including, for example, a gas cylinder, a pressure adjuster, or a flow rate adjuster, whereby the gas pressure inside the collision cell 4 is kept at a gas pressure that is sufficiently higher than the gas pressure in a region inside the chamber 1 and outside of the collision cell 4.

A voltage $\pm(U1+V1\cdot\cos\omega t)$ obtained by combining a DC voltage U1 and a high-frequency voltage $V1\cdot\cos\omega t$ or a voltage $\pm(U1+V1\cdot\cos\omega t)+Vbias1$ obtained by further adding a predetermined DC bias voltage Vbias1 to the voltage $\pm(U1+V1\cdot\cos\omega t)$ is applied from a Q1 power source 11 to the front-stage quadrupole mass filter 3. Only a high-frequency voltage $\pm V2\cdot\cos\omega t$ or a voltage $\pm V2\cdot\cos\omega t+Vbias2$ obtained by adding a predetermined DC bias voltage Vbias2 to the high-frequency voltage $\pm V2\cdot\cos\omega t$ is applied from a q2 power source 12 to the ion guide 5. A voltage $\pm(U3+V3\cdot\cos\omega t)$ obtained by combining a DC voltage U3 and a high-frequency voltage $V3\cdot\cos\omega t$ or a voltage $\pm(U3+V3\cdot\cos\omega t)+Vbias3$ obtained by further adding a predetermined DC bias voltage Vbias3 to the voltage $\pm(U3+V3\cdot\cos\omega t)$ is applied from a Q3 power source 13 to the rear-stage quadrupole mass filter 6. The power sources 11, 12, and 13 operate under the control of a controller 30.

The detector 7 outputs a detection signal corresponding to the number of incident ions, the detection signal is converted into digital data by an analog/digital converter (ADC) 9, and the digital data is inputted to a data processor 20. Based on the collected data, the data processor 20 creates, for example, a mass spectrum, a total ion chromatogram, a mass chromatogram, and the like. The controller 30 for controlling the power sources 11, 12, and 13, the CID gas supplier 8, and the like includes a built-in measurement condition memory 31. Moreover, an input unit 40 for enabling a user to input measurement conditions and the like and a display 41 for enabling the user to check the measurement conditions, measurement results, and the like are connected as a user interface to the controller 30.

At least part of the functions of the data processor 20 and the controller 30 can be realized by installing a dedicated controlling and processing software program on a personal computer provided as hardware resources and executing this program.

In the tandem quadrupole mass spectrometer of the present embodiment, a variety of measurement condition parameters necessary to perform a measurement are stored in advance in the measurement condition memory 31. The memory 31 virtually includes: a transitional storage area rewritable by the user; and a determinate storage area that is not rewritable by the user and is only writable or rewritable by a manufacturer (or a service agent in charge of repairing the mass spectrometer). In general, the mass spectrometer is provided with a function for automatic optimization of measurement conditions, which is called automatic tuning, and parameters that are obtained by the user using this function or parameters that are manually set or changed by an operator are stored in the transitional storage area. Meanwhile, parameters that are obtained by the mass spectrometer manufacturer itself through actual measurements or the like are stored in the determinate storage area.

For example, although omitted in FIG. 1, a voltage for setting gain is applied to the detector 7 including an electron multiplier. A default value of this voltage is stored in the determinate storage area, and the default value is used for a measurement in the state where automatic optimization adjustment of measurement conditions is not performed. If the automatic optimization adjustment of measurement conditions is performed, a voltage value that gives such detector gain that optimizes the ion intensity in a current mass spectrometer state is calculated, and the calculated voltage value is stored in the transitional storage area. In the subsequent measurements, the voltage value parameter stored in the transitional storage area is used in place of the default value.

In the tandem quadrupole mass spectrometer of the present embodiment, a CID gas condition table 31*a* indicating a relation between the scan speed of a mass scan by the front-stage quadrupole mass filter 3 and the CID gas supply pressure is stored in the determinate storage area of the measurement condition memory 31. In the example shown in FIG. 1, the scan speed is divided into two stages of H and L, and CID gas supply pressures P1 and P2 can be respectively set to the two divisions.

Figure 3:
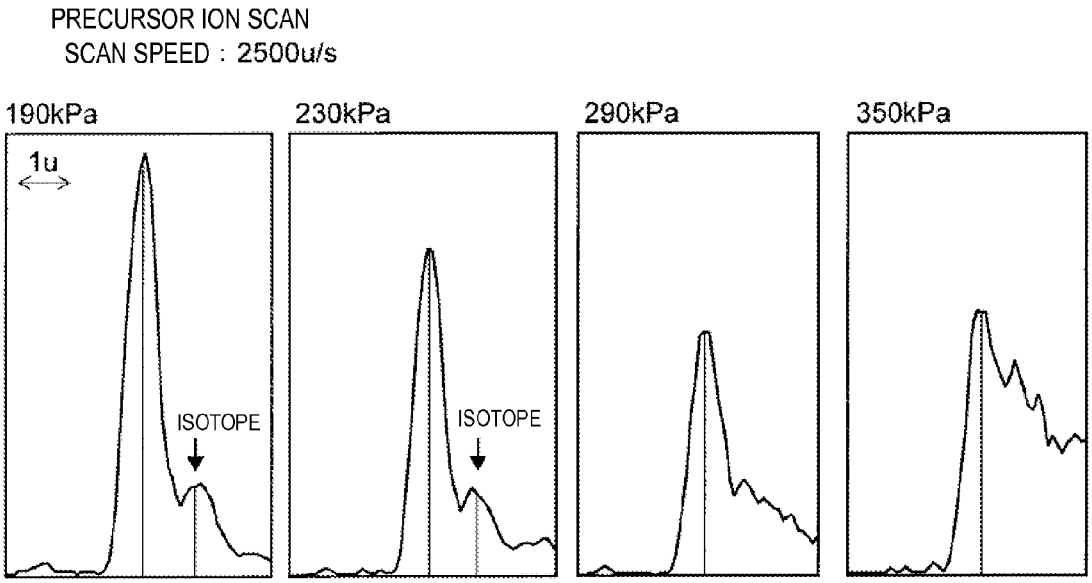
FIG. 3 is a diagram showing an actual measurement example of mass spectra in a precursor ion scan measurement mode at a high scan speed (2,500 u/s).
Figure 4:
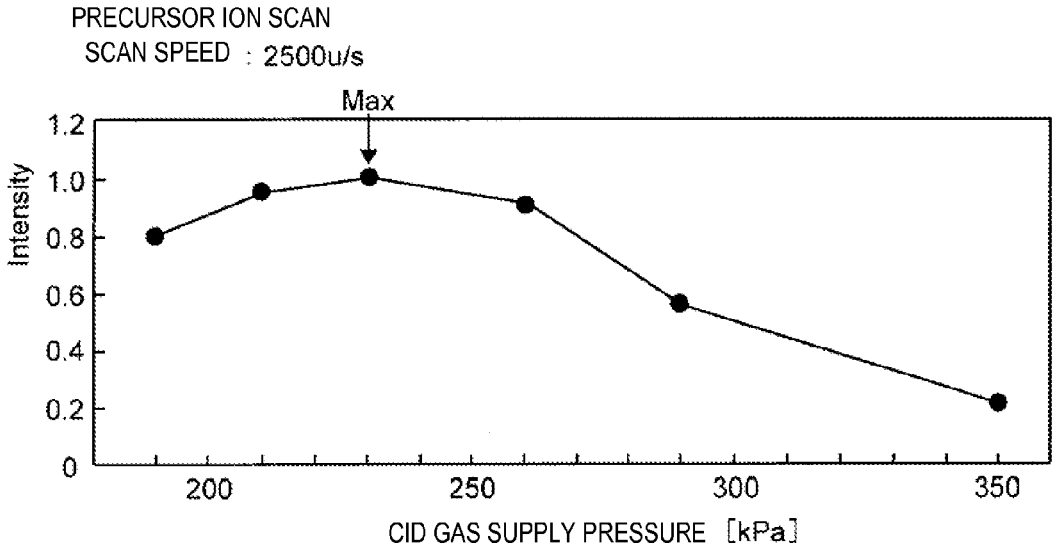
FIG. 4 is a diagram showing an actual measurement example of a relation between a CID gas supply pressure and an ion intensity in the precursor ion scan measurement mode at the high scan speed (2,500 u/s).
Figure 5:
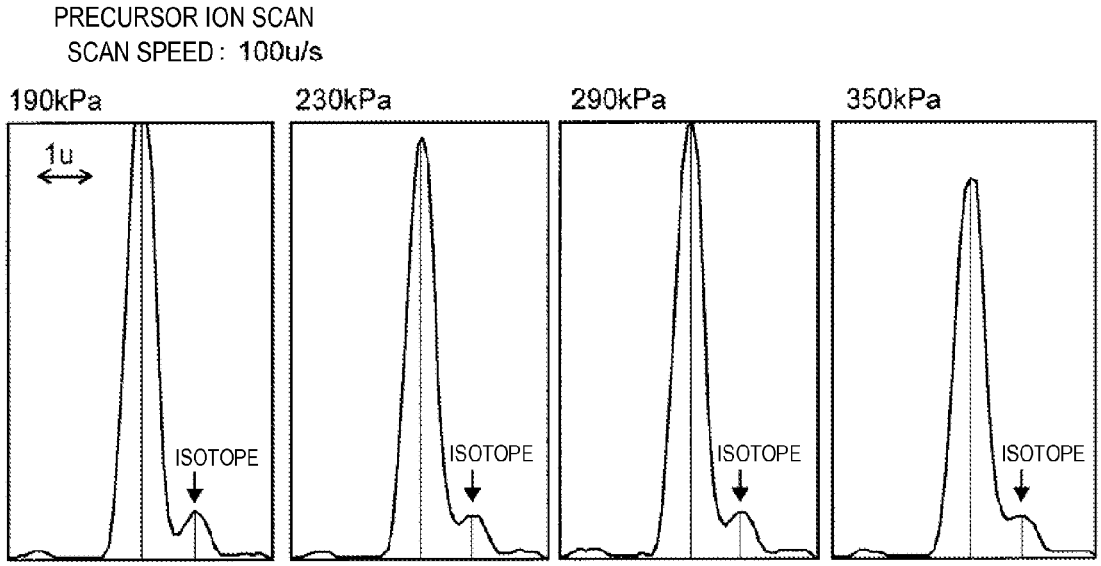
FIG. 5 is a diagram showing an actual measurement example of mass spectra in a precursor ion scan measurement mode at a low scan speed (100 u/s).
Figure 6:
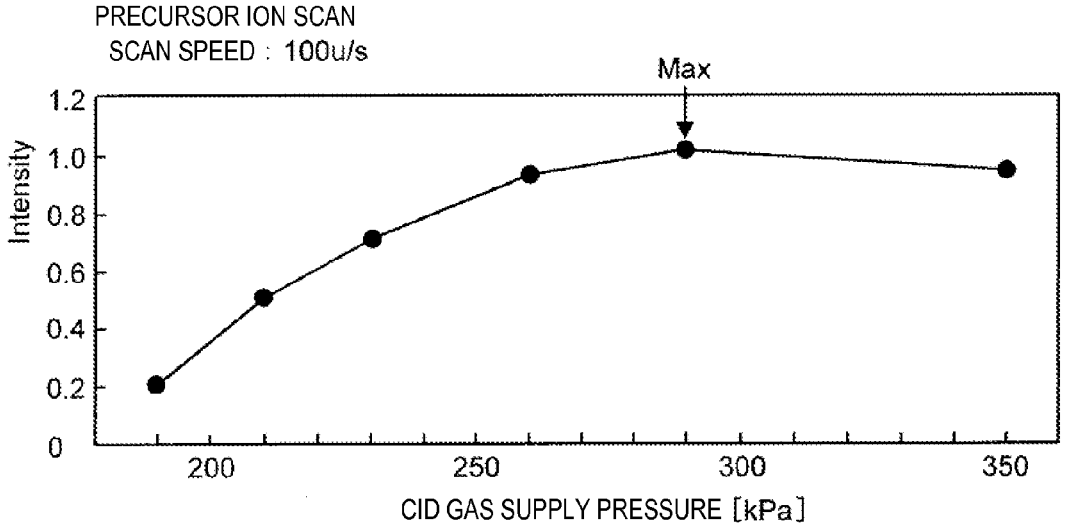
FIG. 6 is a diagram showing an actual measurement example of a relation between a CID gas supply pressure and an ion intensity in the precursor ion scan measurement mode at the low scan speed (100 u/s).

The relation between the scan speed of a mass scan by the front-stage quadrupole mass filter 3 and the CID gas supply pressure is described with reference to actual measurement examples in FIG. 3 to FIG. 6. FIG. 3 is a diagram showing an actual measurement example of mass spectra in a precursor ion scan measurement mode at a high scan speed (2,500 u/s). FIG. 4 is a diagram showing an actual measurement example of the relation between the CID gas supply pressure and the ion intensity in the precursor ion scan measurement mode at the same high scan speed. FIG. 5 is a diagram showing an actual measurement example of mass spectra in a precursor ion scan measurement mode at a low scan speed (100 u/s). FIG. 6 is a diagram showing an actual measurement example of the relation between the CID gas supply pressure and the ion intensity in the precursor ion scan measurement mode at the same low scan speed. These are measurement results obtained from a standard sample containing known compounds.

In the case where a mass scan is performed at the high-speed of 2,500 u/s in the precursor ion scan measurement mode, as shown in FIG. 3, the shape of a peak originating from a target compound gradually decays as the CID gas supply pressure is raised. At 290 [kPa] or more, it is difficult to discriminate a main peak (a peak originating from a compound made of only stable isotope elements) from an isotope peak (a peak originating from a compound containing elements other than stable isotopes) having a mass-to-charge-ratio higher than that of the main peak. At 230 [kPa] or less, it is possible to discriminate the main peak from the isotope peak, and the resolution (full width at half maximum: FWHM) at this time is approximately 0.7 u.

Moreover, as shown in FIG. 4, a decrease in intensity of the peak originating from the target compound is significant when the CID gas supply pressure is raised, but the intensity also decreases even when the CID gas supply pressure is excessively low, for example, 190 [kPa]. This is considered to be because the CID efficiency is decreased by a decrease in chances of collision between the CID gas and precursor ions. In this example, the peak intensity is highest when the CID gas supply pressure is 230 [kPa].

Consequently, according to this actual measurement example, in the precursor ion scan measurement mode at the scan speed of 2,500 u/s, 230 [kPa] can be selected as the CID gas supply pressure that makes the peak shape favorable and makes the peak intensity highest. At this time, a criterion for determining that the peak shape is favorable may be, for example, that the FWHM of the peak is equal to or less than 0.7 u or that a main peak and an isotope peak closest to the main peak are separable (in other words, discriminable) from each other.

Meanwhile, in the case where a mass scan is performed at the low speed of 100 u/s in the precursor ion scan measurement mode, as shown in FIG. 5, even if the CID gas supply pressure is raised, the shape of the peak originating from the target compound does not decay remarkably, and the main peak and the isotope peak are separated from each other at each CID gas supply pressure within the set CID gas supply pressure range. Moreover, as shown in FIG. 6, a decrease in intensity of the peak originating from the target compound is significant when the CID gas supply pressure is lowered, and the peak intensity is highest when the CID gas supply pressure is 290 [kPa].

Consequently, according to this actual measurement example, in the precursor ion scan measurement mode at the scan speed of 100 u/s, the CID gas supply pressure substantially has almost no influence on the peak shape. Hence, focusing on only the peak intensity, 290 [kPa] can be selected as the CID gas supply pressure that makes the peak intensity highest.

Although the results of the above-mentioned actual measurement examples are obtained for the precursor ion scan measurement mode, results depending on a difference in CID gas supply pressure are not influenced by the drive state of the rear-stage quadrupole mass filter 6, and hence results similar to those for the precursor ion scan measurement mode are obtained also for a neutral loss scan measurement mode and a measurement mode in which the rear-stage quadrupole mass filter 6 does not perform ion selection (namely, all ions substantially pass through the rear-stage quadrupole mass filter 6).

In the case where the results of the above-mentioned actual measurement examples are applied to the tandem quadrupole mass spectrometer of the present embodiment shown in FIG. 1, the CID gas supply pressure P1: 230 [kPa] corresponding to the scan speed H: 2,500 u/s and the CID gas supply pressure P2: 290 [kPa] corresponding to the scan speed L: 100 u/s are stored as information for controlling the CID gas supply pressure into the CID gas condition table 31*a*. As a matter of course, these numerical values are given as mere examples.

Description is given of an operation of performing a measurement on an arbitrary sample by the tandem quadrupole mass spectrometer of the present embodiment in which the information is stored in the CID gas condition table 31*a* as described above.

Prior to the measurement, the operator inputs a measurement mode to be executed and measurement conditions necessary to execute the measurement mode, from the input unit 40. It is assumed here that the operator designates the precursor ion scan measurement mode, and sets the scan speed to 1,000 u/s as one of the measurement conditions. Instead of directly setting a value of the scan speed, the scan speed may be, for example, calculated based on other measurement conditions such as the number of mass scans performed in a predetermined period of time (for example, one second), the interval from the end of a given mass scan to the start of the next mass scan, and a mass-to-charge-ratio range.

If a measurement mode (for example, the precursor ion scan measurement mode) in which the front-stage quadrupole mass filter 3 performs a mass scan is designated, the controller 30 reads out the information on the CID gas condition table 31*a* stored in the measurement condition memory 31, and calculates an appropriate CID gas supply pressure corresponding to the currently set scan speed. Specifically, for example, the controller 30 reads out the CID gas supply pressures P1 and P2 respectively corresponding to the two-stage scan speeds H and L, and linearly interpolates the two points, to obtain a relational expression between the scan speed and the CID gas supply pressure. Then, the controller 30 calculates a CID gas supply pressure corresponding to the set scan speed: 1,000 u/s, based on the relational expression. In the above-mentioned numerical value example, the CID gas supply pressure P1 corresponding to the scan speed H: 2,500 u/s is 230 [kPa], and the CID gas supply pressure P2 corresponding to the scan speed L: 100 u/s is 290 [kPa]. Hence, the CID gas supply pressure corresponding to the scan speed: 1,000 u/s is obtained as about 267 [kPa].

The CID gas supply pressure corresponding to the scan speed may not depend on the relational expression obtained through such linear interpolation as described above. For example, simply, a predetermined threshold value may be set for the scan speed, and the CID gas supply pressure may be switched between the case where the scan speed is more than the threshold value and the case where the scan speed is equal to or less than the threshold value. That is, the scan speed may be divided into a plurality of ranges different from one another, and an appropriate CID gas supply pressure may be set for each division. What is important in this regard is that the CID gas supply pressure can be switched in a plurality of stages in accordance with the scan speed of a mass scan by the front-stage quadrupole mass filter 3.

If the appropriate CID gas supply pressure corresponding to the currently set scan speed is obtained as described above, the controller 30 controls the CID gas supplier 8 to supply the CID gas at the appropriate supply pressure, and controls the power sources 11, 12, and 13 to respectively apply predetermined voltages to the front-stage quadrupole mass filter 3, the ion guide 5, and the rear-stage quadrupole mass filter 6. Consequently, a precursor ion scan measurement is performed on the sample. That is, in the ion source 2, compounds in the sample are ionized, and a variety of produced ions are introduced into the front-stage quadrupole mass filter 3. In the front-stage quadrupole mass filter 3, a mass scan in a predetermined mass-to-charge-ratio range is repeated through a scan with the voltage that is applied from the Q1 power source 11 to the front-stage quadrupole mass filter 3, and precursor ions having a scanned mass-to-charge-ratio are introduced into the collision cell 4.

In the collision cell 4, the precursor ions collide with the CID gas and are thus dissociated, and product ions produced through the dissociation are introduced into the rear-stage quadrupole mass filter 6. Because the voltage that is applied from the Q3 power source 13 to the rear-stage quadrupole mass filter 6 is fixed to a predetermined value, product ions having a fixed mass-to-charge-ratio are selected by the rear-stage quadrupole mass filter 6 regardless of the mass-to-charge-ratios of the precursor ions, and the selected product ions reach the detector 7. Based on data obtained through the ADC 9, the data processor 20 creates a mass spectrum (MS/MS spectrum) corresponding to the mass scan of the precursor ions. Because the CID gas pressure inside the collision cell 4 is set to a substantially appropriate value corresponding to the scan speed during the precursor ion scan measurement, the data processor 20 can create a mass spectrum having a favorable peak waveform and a sufficiently high peak intensity, regardless of the scan speed of the mass scan by the front-stage quadrupole mass filter 3.

Similarly in the case where a measurement mode (for example, the neutral loss scan measurement mode or a measurement mode in which: the front-stage quadrupole mass filter 3 performs a mass scan; and a variety of product ions that are produced through CID inside the collision cell 4 are detected without being selected by the rear-stage quadrupole mass filter 6) other than the precursor ion scan measurement mode is designated, the controller 30 may determine a CID gas supply pressure corresponding to the scan speed, based on the information stored in the CID gas condition table 31*a*. In this manner, also in these measurement modes, the data processor 20 can create a mass spectrum having a favorable peak waveform and a sufficiently high peak intensity, regardless of the scan speed.

Meanwhile, in the case where a measurement mode in which the front-stage quadrupole mass filter 3 does not perform a mass scan (for example, a product ion scan measurement mode or a MRM measurement mode) is designated, the scan speed of the mass scan by the front-stage quadrupole mass filter 3 can be regarded as extremely low, and hence the controller 30 may control the CID gas supplier 8 by, for example, selecting the CID gas supply pressure associated with the lowest scan speed in the information stored in the CID gas condition table 31*a*. In this manner, also in the product ion scan measurement mode, the MRM measurement mode, and the like, the controller 30 can create a mass spectrum having a favorable peak waveform and a sufficiently high peak intensity.

Figure 2:
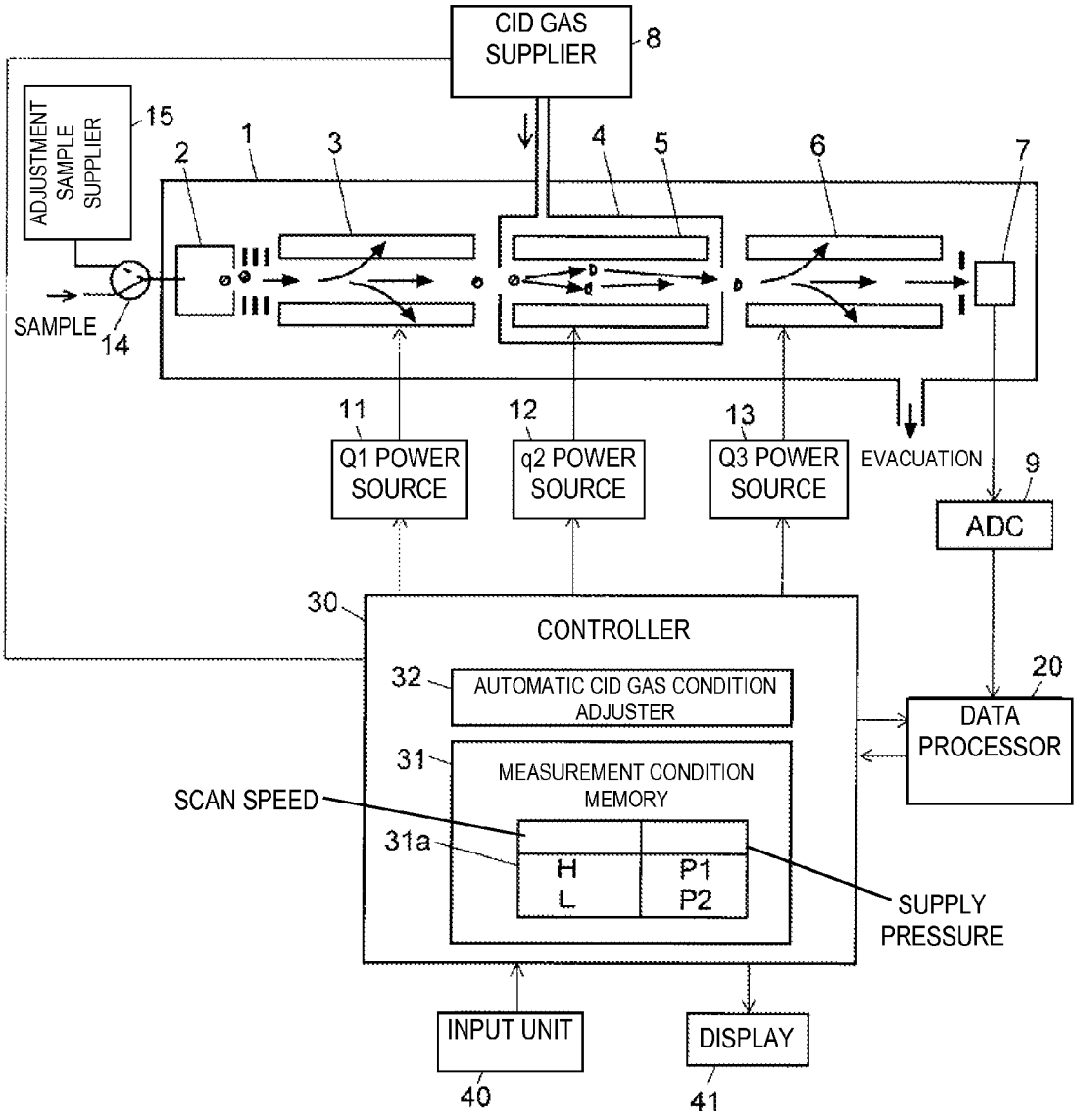
FIG. 2 is a schematic configuration diagram of a main part of a tandem quadrupole mass spectrometer according to a second embodiment of the present invention.

Next, a tandem quadrupole mass spectrometer according to a second embodiment of the present invention is described with reference to FIG. 2. FIG. 2 is a schematic configuration diagram of a main part of the tandem quadrupole mass spectrometer of the second embodiment, in which the same components as those in the mass spectrometer of the first embodiment shown in FIG. 1 are denoted by the same reference signs.

In the tandem quadrupole mass spectrometer of the first embodiment, the information indicating the relation between the scan speed and the CID gas supply pressure is written in advance in the CID gas condition table 31*a*, and the supply pressure of the CID gas supplied to the collision cell 4 is controlled using the information. In comparison, the tandem quadrupole mass spectrometer of the second embodiment includes: an automatic CID gas condition adjuster 32 in charge of control and data processing for automatically calculating, on the user side, the relation between the scan speed and the CID gas supply pressure; and a flow passage switching valve 14 and an adjustment sample supplier 15 for introducing a standard sample for adjustment into the ion source 2 in place of a target sample. Normally, the standard sample for adjustment contains a predetermined compound having a known mass-to-charge-ratio, with high purity.

That is, if the operator gives an instruction to perform automatic parameter adjustment from the input unit 40, the automatic CID gas condition adjuster 32 switches the flow passage switching valve 14 to the adjustment sample supplier 15, and introduces the standard sample for adjustment into the ion source 2. Moreover, the automatic CID gas condition adjuster 32 controls the CID gas supplier 8 to sequentially switch the CID gas supply pressure among a plurality of predetermined values, and controls the power sources 11, 12, and 13 such that a precursor ion scan measurement on a predetermined mass-to-charge-ratio around the mass-to-charge-ratio of ions originating from the compound contained in the standard sample is performed at least once at a different scan speed for each different CID gas supply pressure. The CID gas supply pressure may be switched among, for example, six stages of 190, 210, 230, 260, 290, and 350 [kPa] shown in FIG. 4 and FIG. 6. Moreover, the scan speed may be switched between, for example, two stages of 100 u/s and 2,500 u/s. As a matter of course, the conditions may be switched in smaller units if time allows.

If a measurement on the standard sample is performed as described above, the data processor 20 creates, for each of the CID gas supply pressures in the plurality of stages, such mass spectra as shown in FIG. 3 and FIG. 5 on each of which an ion peak originating from the predetermined compound is observed. The automatic CID gas condition adjuster 32 detects the peak observed on each mass spectrum, and determines an optimum CID gas supply pressure for each scan speed, based on the peak waveform and the peak intensity. With regard to a criterion at this time, as described above, the CID gas supply pressure may be selected so as to: achieve a peak shape in which the FWHM of the peak is equal to or less than 0.7 u or a main peak and an isotope peak closest to the main peak are separable from each other; and make the peak intensity highest. After determining the optimum CID gas supply pressure for each scan speed in this manner, the automatic CID gas condition adjuster 32 writes the resultant information into the CID gas condition table 31*a*.

The control of the CID gas supply pressure during a sample measurement after the CID gas condition table 31*a* is created as described above is the same as that in the first embodiment.

Analyses and data processing concerning the creation of the CID gas condition table 31*a* can be, for example, performed together with automatic tuning for determining optimum values of a voltage parameter applied to each unit and the like.

The CID gas condition table 31*a* created in the tandem quadrupole mass spectrometer of the second embodiment reflects the latest use environment and state of the mass spectrometer. Accordingly, the mass spectrometer of the second embodiment can be considered to be more likely to perform a more favorable measurement, namely, perform such a measurement that makes the peak shape on the mass spectrum more favorable and makes the peak intensity higher, compared with the mass spectrometer of the first embodiment.

Because all the above-mentioned embodiments are given as mere examples of the present invention, even if the embodiments are appropriately changed, added, or modified within the range of the gist of the present invention, the embodiments are obviously encompassed in the scope of claims of the present application.

For example, in the above-mentioned embodiments, the relation between the scan speed and the CID gas supply pressure is stored in the CID gas condition table 31*a*, and, alternatively, a relation between the scan speed and other information (for example, the CID gas supply flow rate or the CID gas pressure itself) concerning the CID gas pressure inside the collision cell 4 may be stored. Moreover, it goes without saying that the relation between the scan speed and the CID gas supply pressure or the like may be stored in not a table form but another form such as a calculation expression.

REFERENCE SIGNS LIST

1 . . . Chamber
2 . . . Ion Source
3 . . . Front-Stage Quadrupole Mass Filter
4 . . . Collision Cell
5 . . . Ion Guide
6 . . . Rear-Stage Quadrupole Mass Filter
7 . . . Detector
8 . . . CID Gas Supplier
11 . . . Q1 Power Source
12 . . . q2 Power Source
13 . . . Q3 Power Source
14 . . . Flow Passage Switching Valve
15 . . . Adjustment Sample Supplier
20 . . . Data Processor
30 . . . Controller
31 . . . Measurement Condition Memory
31*a* . . . CID Gas Condition Table
32 . . . Automatic CID Gas Condition Adjuster
40 . . . Input Unit
41 . . . Display

The invention claimed is:

1. A tandem quadrupole mass spectrometer comprising: a front-stage quadrupole mass filter for selecting, as precursor ions, ions having a specific mass-to-charge-ratio from among a variety of ions; a collision cell for causing the precursor ions to collide with a predetermined gas to dissociate the ions; a rear-stage quadrupole mass filter for selecting ions having a specific mass-to-charge-ratio from among a variety of product ions produced through the dissociation; and a detector for detecting the selected product ions, the tandem quadrupole mass spectrometer further comprising:

a) a gas supplier for supplying the predetermined gas to an inside of the collision cell;

b) a setting information memory for storing information on a gas pressure of the predetermined gas inside the collision cell or control information for supplying the predetermined gas, in association with a scan speed of a mass scan in a measurement mode in which the front-stage quadrupole mass filter performs the mass scan; and c) an analysis controller for controlling the gas supplier such that the gas pressure of the predetermined gas inside the collision cell accords with a scan speed of a mass scan to be performed, based on the information stored in the setting information memory, during execution of a measurement mode in which at least the front-stage quadrupole mass filter performs the mass scan.

2. The tandem quadrupole mass spectrometer according to claim 1, wherein the measurement mode in which the front-stage quadrupole mass filter performs the mass scan includes: a precursor ion scan measurement mode; a neutral loss scan measurement mode; and a measurement mode equivalent to a normal scan measurement mode in which only the front-stage quadrupole mass filter performs the mass scan while the rear-stage quadrupole mass filter does not perform ion selection according to a mass-to-charge-ratio.

3. The tandem quadrupole mass spectrometer according to claim 2, further comprising an automatic setting information creator for:

performing repetitive measurements on a predetermined sample while controlling the gas supplier such that the gas pressure of the predetermined gas inside the collision cell is changed in a plurality of stages in each of stages in which the scan speed of the mass scan is changed in a plurality of stages;

obtaining an appropriate gas pressure for each scan speed of the mass scan, based on a shape of a target peak and an intensity of the peak on a mass spectrum observed through each of the measurements; and storing information on the appropriate gas pressure or the control information for supplying the predetermined gas into the setting information memory, in the measurement mode in which the front-stage quadrupole mass filter performs the mass scan.

4. The tandem quadrupole mass spectrometer according to claim 3, wherein the automatic setting information creator determines such a gas pressure that makes a half-value width of the target peak equal to or less than 0.7 u and makes the peak intensity highest, as the appropriate gas pressure.

5. The tandem quadrupole mass spectrometer according to claim 3, wherein the automatic setting information creator determines such a gas pressure that makes a peak made of only stable isotope elements separable from a peak containing elements other than stable isotopes, among peaks originating from a target compound and makes the peak intensity highest, as the appropriate gas pressure.

6. The tandem quadrupole mass spectrometer according to claim 1, further comprising an automatic setting information creator for:

performing repetitive measurements on a predetermined sample while controlling the gas supplier such that the gas pressure of the predetermined gas inside the collision cell is changed in a plurality of stages in each of stages in which the scan speed of the mass scan is changed in a plurality of stages;

obtaining an appropriate gas pressure for each scan speed of the mass scan, based on a shape of a target peak and an intensity of the peak on a mass spectrum observed through each of the measurements; and storing information on the appropriate gas pressure or the control information for supplying the predetermined gas into the setting information memory, in the measurement mode in which the front-stage quadrupole mass filter performs the mass scan.

7. The tandem quadrupole mass spectrometer according to claim 6, wherein the automatic setting information creator determines such a gas pressure that makes a half-value width of the target peak equal to or less than 0.7 u and makes the peak intensity highest, as the appropriate gas pressure.

8. The tandem quadrupole mass spectrometer according to claim 6, wherein the automatic setting information creator determines such a gas pressure that makes a peak made of only stable isotope elements separable from a peak containing elements other than stable isotopes, among peaks originating from a target compound and makes the peak intensity highest, as the appropriate gas pressure.

* * * * *